US008448423B2

(12) United States Patent
Najt et al.

(10) Patent No.: US 8,448,423 B2
(45) Date of Patent: May 28, 2013

(54) METHOD AND APPARATUS FOR CONTROLLING OPERATION OF A SPARK-IGNITION DIRECT-INJECTION ENGINE

(75) Inventors: Paul M. Najt, Bloomfield Hills, MI (US); Kushal Narayanaswamy, Sterling Heights, MI (US); Kevin L. Perry, Fraser, MI (US); Wei Li, Troy, MI (US); David J. Cleary, Shanghai (CN); James Donald Smith, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 868 days.

(21) Appl. No.: 12/330,587

(22) Filed: Dec. 9, 2008

(65) Prior Publication Data

US 2010/0139248 A1 Jun. 10, 2010

(51) Int. Cl.
*F01N 3/00* (2006.01)

(52) U.S. Cl.
USPC ..... 60/285; 60/274; 60/311

(58) Field of Classification Search
USPC ..... 60/274, 285, 286, 301, 303, 295, 60/297
See application file for complete search history.

(56) References Cited

U.S. PATENT DOCUMENTS 6,491,024 B1 * 12/2002 Connolly et al. ..... 123/406.19
6,691,507 B1 * 2/2004 Meyer et al. ..... 60/285
7,210,288 B2 * 5/2007 Bandl-Konrad et al. ..... 60/297
2001/0018825 A1 * 9/2001 Kuji et al. ..... 60/286
2002/0035831 A1 * 3/2002 Huynh et al. ..... 60/286
2005/0129601 A1 6/2005 Li et al.
2006/0016174 A1 * 1/2006 Surnilla et al. ..... 60/276
2006/0213193 A1 * 9/2006 Koopmans ..... 60/602
2007/0051092 A1 * 3/2007 Pallett et al. ..... 60/276
2008/0089820 A1 4/2008 Jacob
2008/0102010 A1 5/2008 Bruck et al.

FOREIGN PATENT DOCUMENTS

DE 10163022 A1 7/2003

OTHER PUBLICATIONS

U.S. Appl. No. 12/329,162, Perry, et al.
Nakahira, T.,"Catalytic Engine" NOx Reduction of Diesel Engines with New Concept Onboard Ammonia Synthesis System; SAE Technical Paper Series; Feb. 1992; SAE 920469.
Ogunwumi, S.; In-Situ NH3 Generation for SCR NOx Applications; SAE Technical Paper Series; Oct. 2002; SAE 2002-01-2872.

* cited by examiner

*Primary Examiner* — Thomas Denion
*Assistant Examiner* — Matthew T Largi

(57) ABSTRACT

Operation of a spark ignition, direct injection engine having an aftertreatment system including an oxidation catalyst and a selective catalyst reduction device is described. The method includes controlling to a stoichiometric air/fuel ratio and retarding spark ignition timing. Engine fueling is then controlled to a lean air/fuel ratio and spark is retarded. The engine is then operated to generate ammonia reductant. Engine operation then comprises operating at a preferred air/fuel ratio and controlling spark ignition timing to a preferred timing.

10 Claims, 3 Drawing Sheets

METHOD AND APPARATUS FOR CONTROLLING OPERATION OF A SPARK-IGNITION DIRECT-INJECTION ENGINE

TECHNICAL FIELD

This disclosure relates to operation and control of internal combustion engines and exhaust aftertreatment systems, and more specifically to engines operating lean of stoichiometry and associated exhaust aftertreatment systems.

BACKGROUND

The statements in this section merely provide background information related to the present disclosure and may not constitute prior art.

An engine configured for spark ignition combustion can be adapted to operate in a stratified charge combustion mode under predetermined speed/load operating conditions. It is known that operating lean of stoichiometry using a stratified combustion charge can improve fuel economy but can increase exhaust emissions, including nitrides of oxygen (NOx). It is known to use an ammonia-selective catalytic reduction device to reduce NOx in the presence of a reductant, e.g., urea. It is known that refilling a urea tank can burden an operator.

Known aftertreatment systems for internal combustion engines operating lean of stoichiometry can include a three-way catalytic converter (TWC) followed by other exhaust aftertreatment devices, including a lean-NOx reduction catalyst, also referred to as a lean NOx adsorber (hereafter LNT device) and a selective catalytic reduction (hereafter SCR) device. Known TWCs function to reduce engine-out hydrocarbon (HC), carbon monoxide (CO), and NOx emissions during stoichiometric engine operation and HC and CO emissions during lean operation.

Known SCR devices include catalyst material(s) that promotes the reaction of NOx with a reductant, such as ammonia or urea, to produce nitrogen and water. The reductants may be injected into an exhaust gas feedstream upstream of the SCR device, requiring injection systems, tanks and control schemes. The tanks may require periodic refilling and can freeze in cold climates requiring additional heaters and insulation.

Known catalyst materials used in SCR devices have included vanadium (V) and tungsten (W) on titanium (Ti). Mobile applications include base metals including iron (Fe) or copper (Cu) with a zeolite washcoat as catalyst materials. Material concerns for catalyst materials include temperature operating ranges, thermal durability, and reductant storage efficiency. For mobile applications, SCR devices generally have a preferred operating temperature range of 200° C. to 600° C., and may vary depending on the selected catalyst material(s). The preferred operating temperature range can decrease during or after higher load operations. Temperatures greater than 600° C. may cause reductants to breakthrough and degrade the SCR catalysts, and effectiveness of NOx reduction can decrease at temperatures lower than 200° C.

Known LNT devices adsorb NOx emissions during lean engine operation and operate most effectively within a 250° C. to 450° C. temperature range with effectiveness decreasing above and below that temperature range. The LNT device oxidizes the adsorbed NOx emissions only above a light-off temperature.

SUMMARY

A multi-cylinder internal combustion engine is configured for spark ignition and direct fuel injection operation. An exhaust outlet of the engine provides an exhaust gas feedstream fluidly to an exhaust aftertreatment system including a first aftertreatment device fluidly connected upstream of a second aftertreatment device. The first aftertreatment device includes an oxidation catalytic device closely coupled to the exhaust outlet. The second aftertreatment device includes a selective catalyst reduction device having a capacity to store an ammonia reductant. A method for operating the engine includes detecting a start and run event for the engine. Engine operation initially includes controlling engine fueling to achieve a stoichiometric air/fuel ratio upstream of the first aftertreatment device and retarding spark ignition timing by a predetermined amount. Engine operation then includes controlling engine fueling to achieve a lean air/fuel ratio upstream of the first aftertreatment device and retarding the spark ignition timing by a predetermined amount. Engine operation then includes operating the engine in a first combustion mode to generate ammonia reductant in the exhaust gas feedstream upstream of the second aftertreatment device and storing the ammonia reductant on the second aftertreatment device. Engine operation then includes operating the engine at a preferred air/fuel ratio and controlling spark ignition timing to a preferred timing.

BRIEF DESCRIPTION OF THE DRAWINGS

One or more embodiments will now be described, by way of example, with reference to the accompanying drawings, in which.

DETAILED DESCRIPTION

Figure 1:
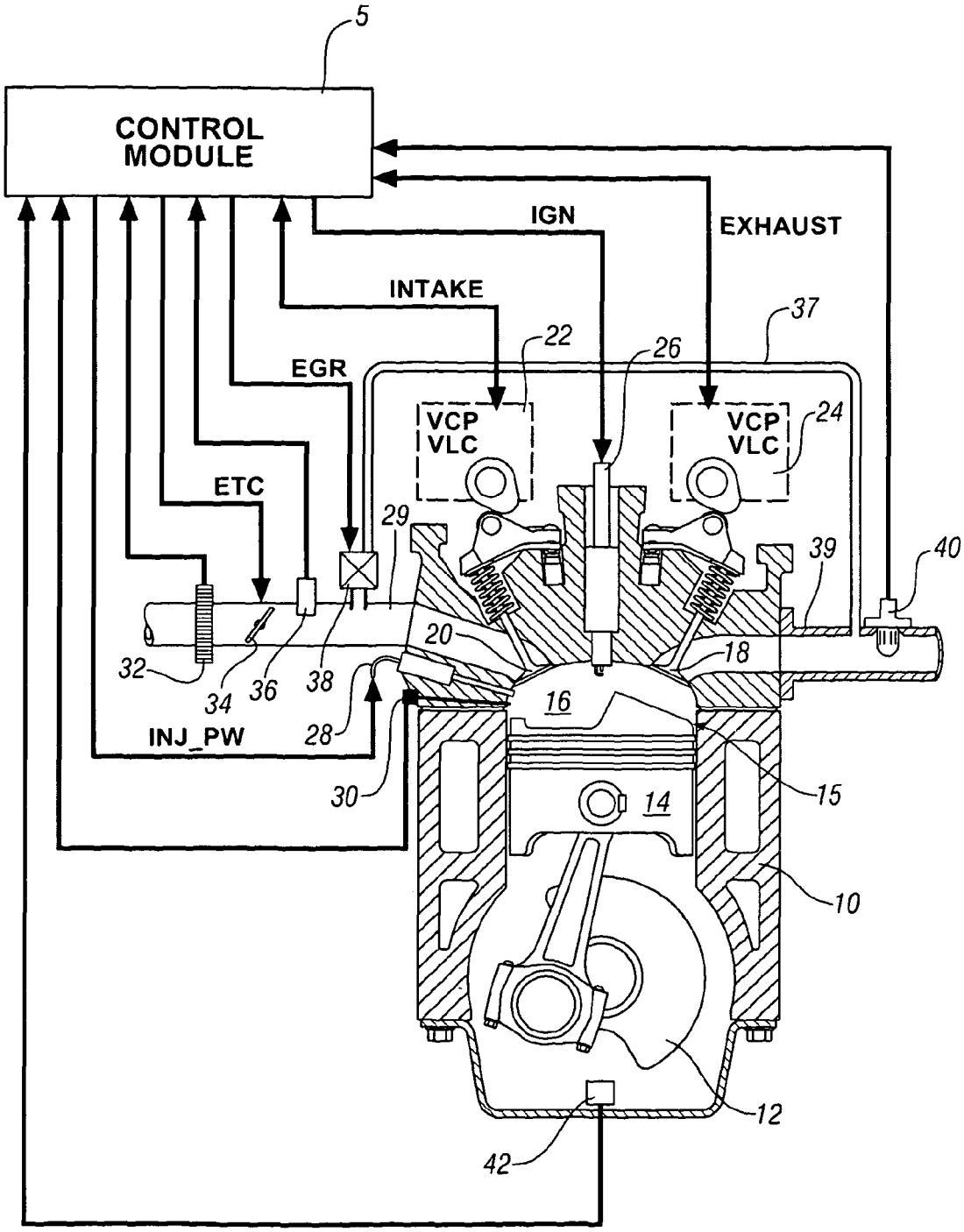
FIG. 1 is a schematic drawing of an engine system in accordance with the present disclosure.

Referring now to the drawings, wherein the showings are for the purpose of illustrating certain exemplary embodiments only and not for the purpose of limiting the same, FIGS. 1, 2, 3, and 4 schematically illustrate an internal combustion engine 10, an exhaust aftertreatment system 45, 45' and an accompanying control system executed in a control module 5 that have been constructed in accordance with an embodiment of the disclosure. Like numerals refer to like elements in the figures.

FIG. 1 shows the engine 10 comprising a multi-cylinder direct-injection four-stroke internal combustion engine having reciprocating pistons 14 slidably movable in cylinders 15 which define variable volume combustion chambers 16. Each piston 14 is connected to a rotating crankshaft 12 by which linear reciprocating piston travel is translated to rotational motion. A single one of the cylinders 15 is shown. The exemplary engine 10 can operate at a lean air/fuel ratio and use a stratified fuel charge control including operating at a high compression ratio with a fuel injector 28 aimed to inject fuel into a subchamber area of the combustion chamber 16 formed at the top of the piston 14, providing a rich charge proximal to a spark plug 26 that ignites easily and burns quickly and smoothly. During each combustion cycle, a flame front moves from a rich region to a lean region to expand for improved combustion and reducing NOx formation. The exemplary engine 10 can operate at stoichiometry or rich of stoichiometry under predetermined conditions. Alternatively, the engine 10 can be configured to operate in a controlled auto-ignition combustion mode.

An air intake system channels intake air to an intake manifold 29 which directs and distributes the air into an intake passage to each combustion chamber 16. The air intake system comprises air flow ductwork and devices for monitoring and controlling the engine intake air flow. The devices preferably include a mass air flow sensor 32 for monitoring mass air flow and intake air temperature. A throttle valve 34, preferably comprising an electronically controlled device, controls air flow to the engine 10 in response to a control signal (ETC) from the control module 5. A manifold pressure sensor 36 monitors manifold absolute pressure and barometric pressure in the intake manifold 29. An external flow passage 37 having a flow control valve 38 (exhaust gas recirculation or EGR valve) can recirculate residual exhaust gases from an exhaust manifold 39 to the intake manifold 29. The control module 5 preferably controls mass flow of recirculated exhaust gas to the intake manifold 29 by controlling magnitude of opening of the EGR valve 38.

Air flow from the intake manifold 29 into the combustion chamber 16 is controlled by one or more intake valve(s) 20. Exhaust flow out of the combustion chamber 16 to the exhaust manifold 39 is controlled by one or more exhaust valve(s) 18. Openings and closings of the intake and exhaust valves 20 and 18 are preferably controlled with a dual camshaft (as depicted), the rotations of which are linked and indexed with rotation of the crankshaft 12. A VCP/VLC device 22 preferably comprises a controllable mechanism operative to variably control valve lift (VLC) and variably control cam phasing (VCP) of the intake valve(s) 20 for each cylinder 15 in response to a control signal (INTAKE) from the control module 5. A VCP/VLC device 24 preferably comprises a controllable mechanism operative to variably control valve lift (VLC) and variably control phasing (VCP) of the exhaust valve(s) 18 for each cylinder 15 in response to a control signal (EXHAUST) from the control module 5. The VCP/VLC devices 22 and 24 each preferably include a controllable two-step valve lift mechanism operative to control magnitude of valve lift, or opening, of the intake and exhaust valve(s) 20 and 18 to one of two discrete steps. The two discrete steps preferably include a low-lift valve open position (about 4-6 mm) for load speed, low load operation, and a high-lift valve open position (about 8-10 mm) for high speed and high load operation. The VCP/VLC devices 22 and 24 preferably include variable cam phasing mechanisms to control phasing (i.e., relative timing) of opening and closing of the intake valve(s) 20 and the exhaust valve(s) 18 respectively. The phasing refers to shifting opening times of the intake and exhaust valve(s) 20 and 18 relative to positions of the crankshaft 12 and the piston 14 in the respective cylinder 15. The variable cam phasing systems of the VCP/VLC devices 22 and 24 preferably have a range of phasing authority of about 60°-90° of crank rotation, thus permitting the control module 5 to advance or retard opening and closing of one of intake and exhaust valve(s) 20 and 18 relative to position of the pistons 14 for each cylinder 15. The range of phasing authority is defined and limited by the VCP/VLC devices 22 and 24. The VCP/VLC devices 22 and 24 include camshaft position sensors (not shown) to determine rotational positions of the intake and the exhaust camshafts (not shown). The VCP/VLC devices 22 and 24 are actuated using one of electro-hydraulic, hydraulic, and electric control force, controlled by the control module 5.

A fuel injection system includes a plurality of individually controlled high-pressure fuel injectors 28 each adapted to directly inject a mass of fuel into the combustion chamber 16 in response to a control signal (INJ_PW) from the control module 5. As used herein, fueling refers to an injecting fuel flow into one of the combustion chambers 16. The fuel injectors 28 are supplied pressurized fuel from a fuel distribution system (not shown). The engine 10 includes a spark ignition system by which spark energy is provided to the spark plug 26 for igniting or assisting in igniting cylinder charges in each combustion chamber 16 in response to a control signal (IGN) from the control module 5. The control signal controls spark timing relative to position of the piston 14 in the combustion chamber 30 and spark dwell time.

The engine 10 is equipped with other sensing devices for monitoring engine operation, each which is signally connected to the control module 5. Sensing devices include a crank sensor 42 operative to monitor crankshaft rotational position, i.e., crank angle and speed and the exhaust gas feedstream monitoring sensor(s) 40. In one embodiment, a combustion sensor 30 can monitor in-cylinder combustion in real-time during ongoing operation of the engine 10. The exhaust aftertreatment system 45 is equipped with one or more sensing device(s) to monitor the exhaust gas feedstream downstream of one or more aftertreatment devices. Signal outputs of the sensing device(s) are monitored by the control module 5 for controlling and diagnosing operation.

The control system is executed as a set of control algorithms in the control module 5 to control operation of the engine 10. The control module 5 preferably comprises a general-purpose digital computer including a microprocessor or central processing unit, storage mediums comprising non-volatile memory including read only memory and electrically programmable read only memory, random access memory, a high speed clock, analog to digital conversion circuitry and digital to analog circuitry, and input/output circuitry and devices, and appropriate signal conditioning and buffer circuitry. The control module 5 executes the control algorithms to control operation of the engine 10. The control algorithms comprise resident program instructions and calibrations stored in the non-volatile memory and executed to provide the respective functions of each computer. The algorithms are executed during preset loop cycles such that each algorithm is executed at least once each loop cycle. Algorithms are executed by the central processing unit to monitor inputs from the aforementioned sensing devices and execute control and diagnostic routines to control operation of the actuators, using preset calibrations. Loop cycles are executed at regular intervals, for example each 3.125, 6.25, 12.5, 25 and 100 milliseconds during ongoing engine and vehicle operation. Alternatively, algorithms may be executed in response to occurrence of an event. The engine 10 is controlled to operate at a preferred air-fuel ratio to achieve performance parameters related to operator requests, fuel consumption, emissions, and driveability, with the intake air flow controlled to achieve the preferred air-fuel ratio.

Figure 2:
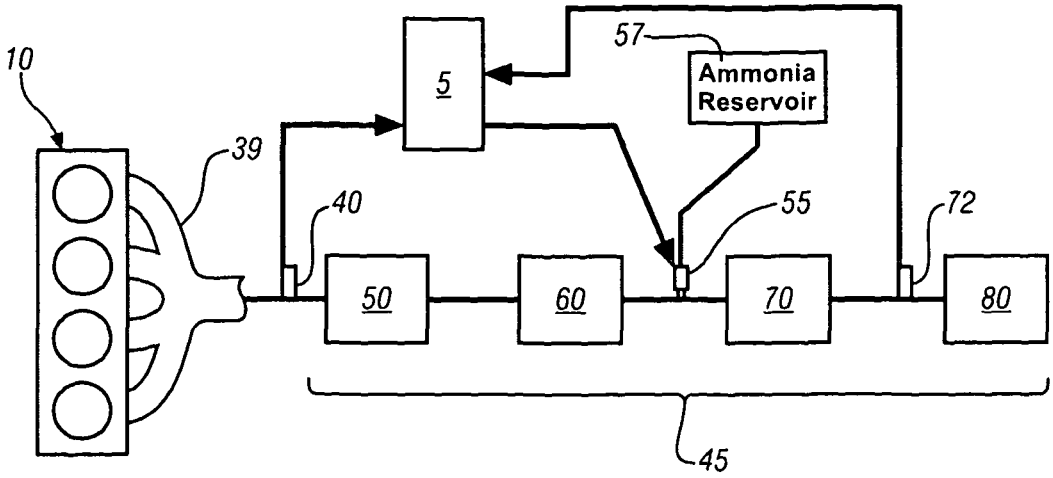
FIGS. 2, 3, and 4 are schematic block diagrams of exhaust aftertreatment systems in accordance with the present disclosure.
Figure 3:
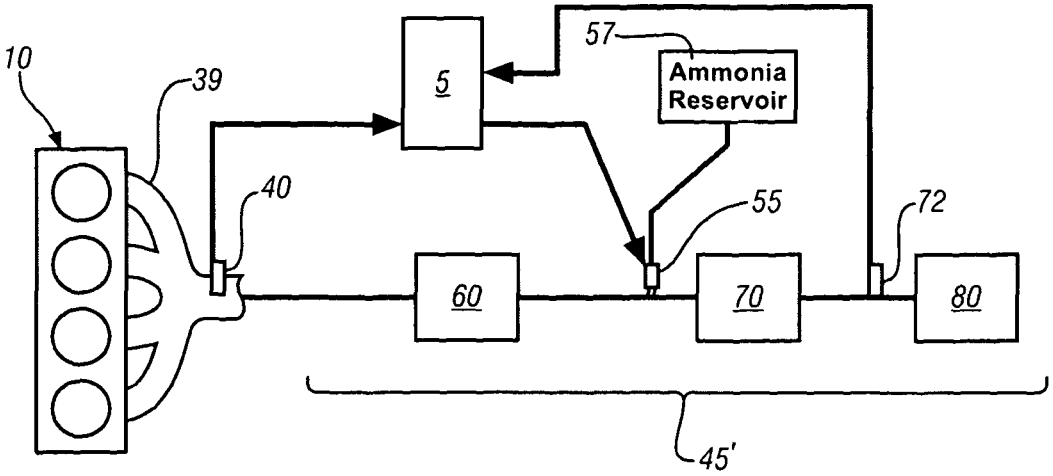
Figure 4:
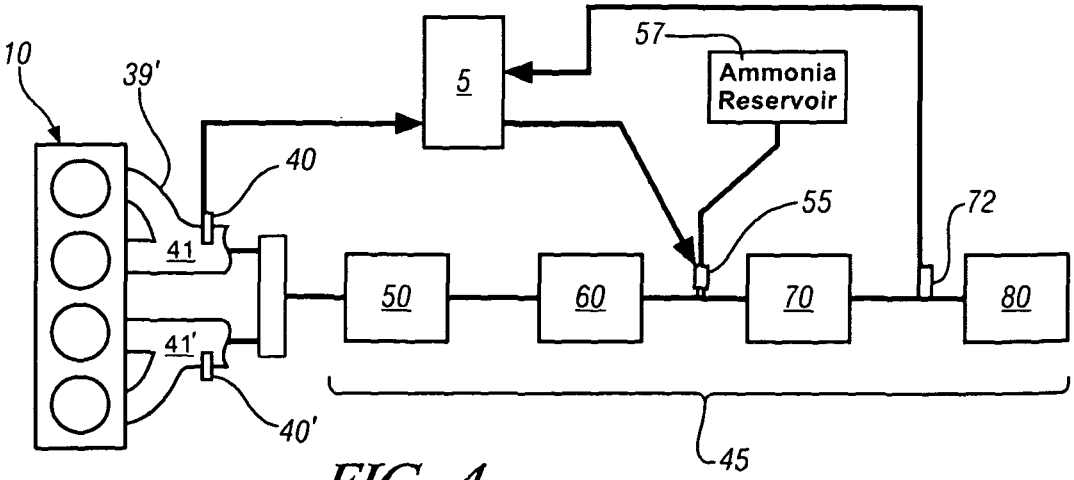

FIGS. 2, 3 and 4 schematically show embodiments of the exhaust manifold 39 and 39' and the exhaust aftertreatment system 45, 45' fluidly coupled thereto to manage and treat the exhaust gas feedstream. FIG. 2 shows an embodiment with the exhaust manifold 39 entraining exhaust gas flow from all the engine cylinders to the exhaust aftertreatment system 45 including an exhaust gas feedstream monitoring sensor 40, which comprises a wide range air/fuel ratio sensor in one embodiment. FIG. 3 shows an embodiment with the exhaust manifold 39 entraining exhaust gas flow from all the engine cylinders to the exhaust aftertreatment system 45'. FIG. 4 shows an embodiment with an exhaust manifold 39' mechanically separated into first and second sections 41 and 41' with the first section 41 entraining exhaust gas flow from a first set of engine cylinders and with the second section 41' entraining exhaust gas flow from a second set of engine cylinders. The first and second sections 41 and 41' include exhaust gas feedstream monitoring sensors 40 and 40' to monitor the exhaust gas feedstream from one of the first and second sections 41 and 41' to the exhaust aftertreatment system 45, permitting use of split air/fuel ratio control schemes associated with the first and second sets of the engine cylinders. The split air/fuel ratio control scheme can be used to selectively control fueling to the first and second sets of the engine cylinders to achieve different predetermined air/fuel ratios that can be combined into an overall preferred air/fuel ratio entering the aftertreatment device 50.

FIGS. 2 and 4 each show a first embodiment of the exhaust aftertreatment system 45 comprising a plurality of aftertreatment devices fluidly connected in series, including aftertreatment devices 50, 60, 70 and 80. Preferably, a reductant injection device 55 is assembled into the exhaust aftertreatment system 45 upstream of the aftertreatment device 70. FIG. 3 shows a second embodiment of the exhaust aftertreatment system 45' comprising the aftertreatment devices fluidly connected in series, including aftertreatment devices 60, 70 and 80. An exhaust gas feedstream monitoring sensor 72 is preferably placed downstream of the aftertreatment device 70 to monitor NOx emissions. In one embodiment, a monitoring sensor (not shown) can be placed upstream of the aftertreatment device 70 to monitor the exhaust gas feedstream upstream of the aftertreatment device 70 and preferably upstream of the reductant injection device 55. The aftertreatment devices 50, 60, 70 and 80 can be assembled into individual structures that are fluidly connected and assembled in an engine compartment and a vehicle underbody with one or more sensing devices (not shown) placed therebetween. Alternatively, the aftertreatment devices 50 and 60 can be assembled into a first structure located in the engine compartment and the aftertreatment devices 70 and 80 can be assembled into a second structure located in the underbody. One skilled in the art can conceive of other assembly configurations. In one embodiment, temperature monitoring sensor (s) (not shown) can be incorporated into the structures of one or more of the aftertreatment devices 50, 60, 70, and 80 to monitor and determine operating temperatures thereof.

In one embodiment, the aftertreatment device 50 includes a particulate filter (not shown) for removing particulate matter from the exhaust gas feedstream. The particulate filter comprises a cordierite substrate having alternately plugged flow passages that cause the exhaust gas feedstream to flow through walls of the substrate, filtering or stripping particulate matter out of the exhaust gas feedstream. One having skill in the art can conceive other types of particulate filter designs, including e.g., flow-through metallic foam filters, ceramic foam fibers, wound and knitted fibers, fiber papers and fabrics, sintered metal fibers, and pleated paper filters. In one embodiment, the particulate filter can include the cordierite substrate having an alumina-based washcoat containing one or more platinum-group metals, e.g., Pt, Pd, and Rh. The aftertreatment device 50 is preferably closely coupled to the exhaust manifold 39. A pressure sensor (not shown) can be used to measure exhaust gas pressure upstream of the aftertreatment device 50, i.e., the particulate filter.

The aftertreatment device 60 preferably comprises a three-way/oxidation catalytic device, preferably comprising a cordierite substrate (not shown) having an alumina-based washcoat containing one or more platinum-group metals, e.g., Pt, Pd, Rh and cerium for oxygen storage and release functionality. Ammonia can be generated from NOx in the presence of reformates in one of the aftertreatment devices 50 and 60.

In the embodiments shown in FIGS. 2 and 4, the aftertreatment device 60 is preferably closely coupled to the first aftertreatment device 50 which is preferably closely coupled to the exhaust manifold 39, 39'. In the embodiment shown in FIG. 3, the aftertreatment device 60 is preferably closely coupled to the exhaust manifold 39.

The aftertreatment device 70 comprises an ammonia-SCR catalytic device, preferably comprising a cordierite substrate (not shown) having a zeolite-based washcoat containing one or more metals, e.g., Fe, Cu, V, W, and Ti.

The aftertreatment device 80 preferably comprises an ammonia slip catalytic device, comprising a cordierite substrate (not shown) having an alumina-based washcoat containing one or more platinum-group metals, e.g., Pt, Pd, Rh, operative to oxidize NH3 and other exhaust gas feedstream constituents.

Design features for each of the catalytic devices, e.g., volume, space velocity, cell densities, washcoat densities, and metal loadings can be determined for specific applications by a person having skill in the art.

In one embodiment, the exhaust aftertreatment system 45 includes the reductant injection device 55 having an injection mechanism and a nozzle (not shown) that are fluidly connected to a refillable reservoir 57 that preferably contains urea or another suitable reductant that includes NH3. The nozzle of the reductant injection device 55 is inserted into the exhaust aftertreatment system 45 upstream of the aftertreatment device 70. The reductant injection device 55 is controlled by the control module 5 to inject a mass flowrate of urea into the exhaust gas feedstream corresponding to the mass of NOx emissions therein, preferably in excess of or near a NOx/urea stoichiometry point.

The individual aftertreatment devices of the exhaust aftertreatment system 45 operate most effectively within preferred operating temperature ranges that are above ambient temperatures. A control strategy to operate the engine 10 to warm up the individual aftertreatment devices can be employed when the engine 10 is started and operated subsequent to a soak period during which elements of the aftertreatment system 45 achieve temperatures that approach ambient temperature. The control strategy to operate the engine 10 preferably includes multiple phases that are sequentially executed.

The engine 10 is controlled in a first phase immediately after engine starting and running. The first phase includes operating the engine 10 at an overall stoichiometric air/fuel ratio preferably using a multiple pulse fuel injection strategy, wherein a portion of the fuel is injected late in the combustion cycle. Timing of spark ignition is retarded relative to a mean-best-torque spark ignition timing for operating the engine. Overall fueling and spark operation includes meeting an operator request for output torque. Operating the engine 10 thusly maximizes transferring thermal energy from the engine 10 into the exhaust gas feedstream to facilitate rapid warm up of the aftertreatment devices 50 and 60. The engine 10 is controlled in the first phase to increase temperatures of aftertreatment devices 50 and 60 until a light-off temperature is achieved that permits exothermic catalytic activity. The engine 10 can be controlled in the first phase for a period of time that is preferably predetermined based upon factors including ambient temperature and thermal capacity of the aftertreatment system 45.

The engine 10 is controlled in a second phase when the temperatures of the aftertreatment devices 50 and 60 achieve light-off temperatures. The second phase includes operating the engine 10 at a predetermined air/fuel ratio that is overall a lean air/fuel ratio and is preferably achieved using the multiple pulse fuel injection strategy. Timing of spark ignition continues to be retarded relative to a mean-best-torque spark ignition timing. Overall fueling and spark operation includes meeting an operator request for output torque. Operating the engine 10 thusly chemically generates a hot oxidizing exhaust gas feedstream for oxidizing exhaust gas constituents, e.g., HC and CO, to heat the aftertreatment devices 70 and 80. The engine 10 is controlled in the second phase to increase temperatures of the aftertreatment devices 50 and 60 and the aftertreatment devices 70 and 80, until light-off temperatures are achieved that permit effective catalytic activity. When one of the aftertreatment devices 70 and 80 comprises an underfloor LNT device, the light-off temperature is based upon an ability to store NOx. When one of the aftertreatment devices 70 and 80 comprises an underfloor SCR system, the light-off temperature is based upon an efficient NOx conversion rate.

The engine 10 can be controlled in the second phase for a period of time that is preferably predetermined based upon factors including the ambient temperature and thermal capacity of the aftertreatment system 45.

When the exhaust aftertreatment system 45 includes the aftertreatment device 50 comprising the particulate filter, the engine 10 can be controlled to a third phase to regenerate the particulate filter by oxidizing the filtered particulate matter. This includes operating the engine 10 at a predetermined air/fuel ratio that is overall a lean air/fuel ratio. Operating the engine 10 at the overall predetermined air/fuel ratio can be achieved using the split fuel injection strategy, as shown with reference to FIG. 4. Timing of spark ignition is controlled to operate the engine to achieve mean-best-torque. Overall fueling and spark operation includes meeting an operator request for output torque. Operating the engine 10 thusly generates a hot oxidizing exhaust gas feedstream for oxidizing particulate matter in the particulate filter of the aftertreatment device 50. The third phase to regenerate the particulate filter can continue for a predetermined period of time. Alternatively, the third phase to regenerate the particulate filter can continue until there is an indication that the particulate filter has been substantially regenerated, e.g., by monitoring a pressure drop across the particulate filter using the aforementioned pressure sensor (not shown) operative to measure exhaust gas pressure upstream of the aftertreatment device 50, i.e., the particulate filter.

The engine is controlled in a fourth phase to generate reformates comprising NOx, CO and hydrogen in the exhaust gas feedstream. In one embodiment generating reformates includes operating the engine 10 at a rich air/fuel ratio and advancing timing of the spark ignition to generate reformates. In one embodiment, this includes operating the engine 10 at an air-fuel ratio ranging from near stoichiometry to 30:1 and injecting additional fuel using a late-combustion fuel injection or a post-combustion fuel injection strategy to generate the reformates. Reformates can be generated by injecting an amount of fuel into the combustion chamber at the end of a combustion phase of each combustion cycle, or alternatively during an exhaust phase of each combustion cycle. The reformates react in the aftertreatment device 60 to form an NH3 reductant from NOx and hydrogen. The process of controlling operation of the engine 10 to form the NH3 reductant in the exhaust gas feedstream is referred to as passive NH3 SCR operation. The NH3 reductant is storable on the aftertreatment device 70. Excess NH3 reductant that passes through the aftertreatment device 70, referred to as ammonia slip, can be oxidized in the aftertreatment device 80. Preferably, the control system operates the engine in the fourth phase and monitors signal output from the monitoring sensor 72 to detect ammonia slip. When ammonia slip greater than a predetermined level is detected, the control system transitions to the fifth phase.

The engine is controlled in the fifth phase subsequent to the fourth phase. The fifth phase comprises operating the engine 10 in the preferred operating state for the engine 10, which is a lean stratified-charge operation in this embodiment. Alternatively, the preferred operating state can comprise a stoichiometric spark-ignition operation, or a lean controlled auto-ignition operation, i.e., homogeneous charge compression ignition operation preferably with the spark ignition disabled.

The exhaust gas feedstream contains NOx which passes through the aftertreatment devices 50 and 60 and is reduced to N2 in the aftertreatment device 70 in the presence of the stored NH3 reductant. The engine 10 can operate under such conditions until the NH3 reductant is substantially depleted or another opportunity to create NH3 reductant is presented, such as during the cold start operation and during a high load operation or an acceleration event. The engine 10 can operate under some steady-state cruise conditions in a lean combustion mode with a second fuel pulse injected late in the combustion cycle. When the stored NH3 reductant is substantially depleted, the engine 10 can be controlled to operate at or near stoichiometry in order to minimize NOx generation and permit the aftertreatment device 60 to operate and use the three-way catalytic function and oxygen storage/release function to oxidize HC and CO and reduce NOx in the presence of stored oxygen. For purposes of this description, the NH3 reductant is substantially depleted when there is insufficient NH3 reductant stored in the aftertreatment device 70 to reduce NOx in the exhaust gas feedstream to meet a predetermined NOx concentration, measured by way of example in mass of NOx over distance traveled, e.g., mg(NOx)/km.

The process of operating the reductant injection device 55 to inject urea into the exhaust gas feedstream is referred to as active urea dosing. The NOx emissions are reduced to nitrogen in the aftertreatment device 70 in the presence of NH3 in urea. The active urea dosing can be used during high load engine operation and at low load engine operation when the ammonia stored on the aftertreatment device 70 is substantially depleted, and at other periods during engine operation.

In one embodiment, the active urea dosing is used in combination with the passive NH3 SCR operation to reduce NOx emissions. During engine operation, e.g., under low load and steady state conditions, the engine 10 is operated at a lean air/fuel ratio, preferably in a range that is greater than 20:1. The exhaust gas feedstream contains NOx which passes through the aftertreatment devices 50 and 60 and is reduced to N2 in the aftertreatment device 70 in the presence of the stored NH3. Under specific operating conditions, e.g., high engine load operation or acceleration, active urea dosing can be used in combination with passive NH3 SCR operation to reduce NOx emissions. The engine 10 can operate under such conditions until the NH3 is substantially depleted or another opportunity to create NH3 is presented, such as during a high load operation or during an acceleration event.

The control system preferentially controls engine operation using the passive NH3 SCR operation under specific operating conditions, including when a sufficient or predetermined amount of NH3 has been stored on the aftertreatment device 70. The active urea dosing can be deactivated when the engine 10 is operating at low and medium load operating conditions including steady state operation with sufficient amount of stored NH3. When the stored NH3 on the aftertreatment device 70 is substantially depleted, the active urea dosing is activated and engine operation and urea injection are controlled in accordance with the active urea dosing to achieve a desired urea/NOx ratio in the aftertreatment device 70 for efficient NOx reduction. In event of a detected fault in the reductant injection device 55, including the ammonia reservoir tank 57 being empty, the engine 10 can be controlled to operate at or near stoichiometry in order to minimize NOx generation. The aftertreatment device 60 operates using the three-way catalytic function and oxygen storage/release to oxidize HC and CO and reduce NOx in the presence of stored oxygen.

Figure 5:
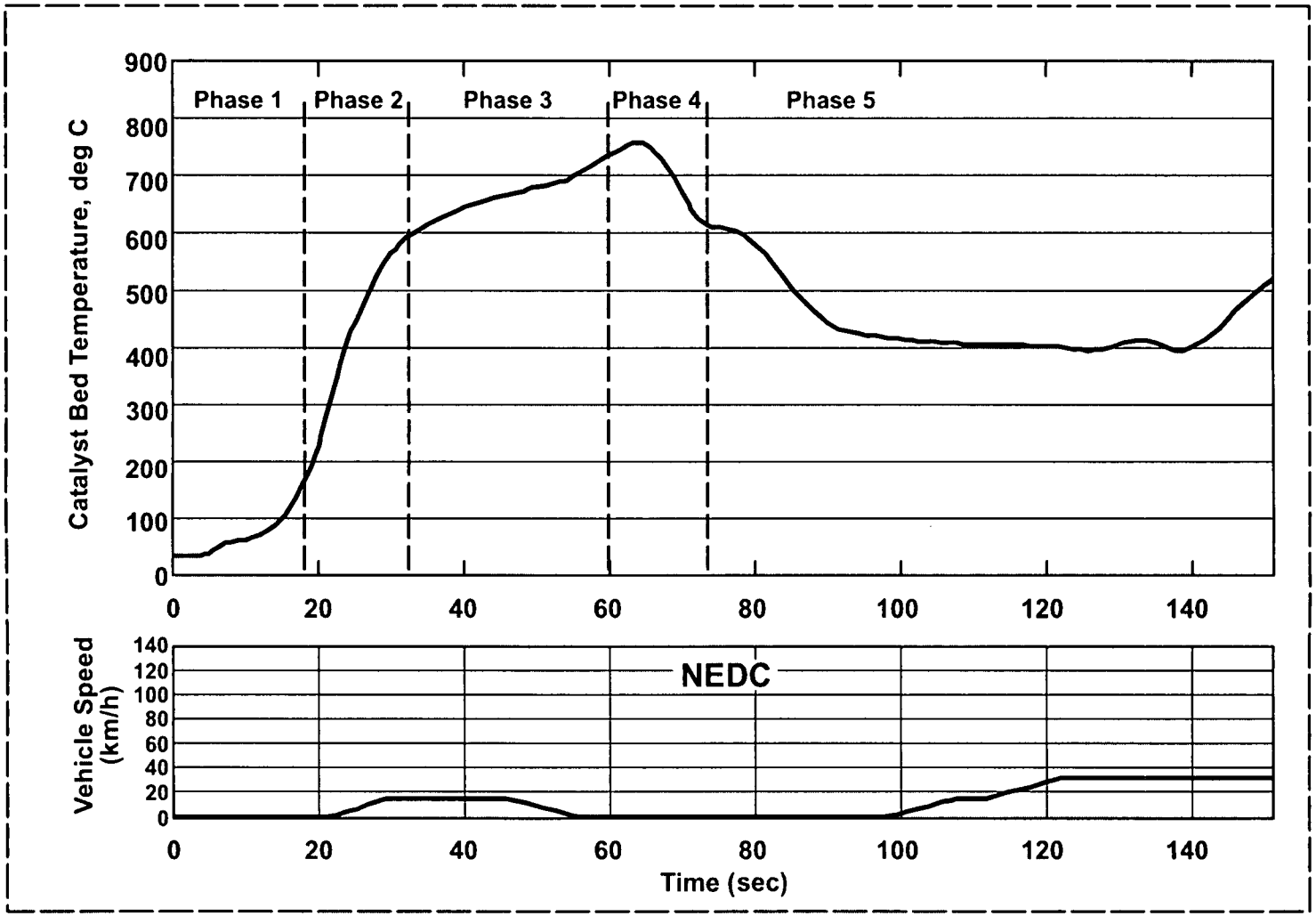
FIG. 5 is a data graph in accordance with the present disclosure.

FIG. 5 shows temperature of the oxidation catalytic device 60 (labeled 'Catalyst Bed Temperature') for an exemplary system over elapsed time subsequent to an engine start and run event over an NEDC drive cycle. The temperature of the oxidation catalytic device 60 is shown for each of the first second, third, fourth, and fifth phases, indicating points at which transitions are made from one phase to a subsequent phase based upon temperature.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for operating a multi-cylinder, spark-ignition, direct-injection, internal combustion engine having an exhaust outlet providing an exhaust gas feedstream fluidly connected to an exhaust aftertreatment system comprising a particulate filter device upstream of a first aftertreatment device fluidly connected upstream of a second aftertreatment device, the first aftertreatment device comprising an oxidation catalytic device, wherein the particulate filter device and the oxygen catalytic device are closely coupled to the exhaust outlet and the second aftertreatment device comprising a selective catalyst reduction device having a capacity to store an ammonia reductant, the method comprising:

detecting a start and run event for the engine; and then initially controlling the engine at a stoichiometric air/fuel ratio using a multiple pulse fuel injection strategy wherein a portion of the fuel is injected late in the combustion cycle and retarding spark ignition timing relative to mean-best-torque timing for a period of time associated with achieving light-off temperature in the first aftertreatment device; and then controlling the engine at a lean air/fuel ratio using the multiple pulse fuel injection strategy wherein a portion of the fuel is injected late in the combustion cycle and retarding the spark ignition timing relative to mean-best-torque timing for a period of time associated with achieving an efficient NOx conversion rate in the second aftertreatment device; and then operating the engine at a lean air/fuel ratio and controlling spark ignition timing to a preferred timing; and then operating the engine in a first combustion mode comprising operating at a rich air/fuel ratio and advancing the spark ignition timing to generate reformates that form an ammonia reductant in the first aftertreatment device and storing the ammonia reductant on the second aftertreatment device until ammonia slip from the second aftertreatment device exceeds a predetermined level; and then operating the engine at a preferred air/fuel ratio and controlling spark ignition timing to a preferred timing until the stored ammonia reductant is depleted.

2. The method of claim 1, wherein operating the engine at a preferred air/fuel ratio and controlling spark ignition timing to a preferred timing comprises operating the engine lean of stoichiometry in a stratified charge combustion mode and controlling spark ignition timing to a preferred timing to achieve a mean-best-torque.

3. The method of claim 1, further comprising injecting reductant into the exhaust gas feedstream at a point upstream of the selective catalyst reduction device.

4. The method of claim 1, wherein operating the engine at a preferred air/fuel ratio and controlling spark ignition timing to a preferred timing comprises operating the engine in a controlled auto-ignition combustion mode and disabling spark ignition.

5. The method of claim 1, wherein operating the engine at a preferred air/fuel ratio and controlling spark ignition timing to a preferred timing comprises operating the engine at stoichiometry and controlling spark ignition timing to a preferred timing to achieve a mean-best-torque.

6. The method of claim 1, further comprising monitoring pressure drop across the particulate filter device upstream of the oxidation catalytic device; and discontinuing operating the engine at the lean air/fuel ratio and controlling spark ignition timing to the preferred timing when the pressure drop across the particulate filter device is less than a predetermined threshold.

7. The method of claim 1, further comprising controlling the engine fueling to achieve a stoichiometric air/fuel ratio upstream of the first aftertreatment device by controlling a first set of the engine cylinders to a lean air/fuel ratio and controlling a second set of the engine cylinders to a rich air/fuel ratio.

8. The method of claim 1, further comprising controlling the engine fueling to achieve a lean air/fuel ratio upstream of the first aftertreatment device by controlling a first set of the engine cylinders to a first lean air/fuel ratio and controlling a second set of the engine cylinders to a second lean air/fuel ratio.

9. Method for operating a multi-cylinder, spark-ignition, direct-injection, internal combustion engine having an exhaust outlet providing an exhaust gas feedstream closely fluidly coupled to a particulate filter fluidly coupled to an oxidation catalytic device fluidly coupled to a selective catalyst reduction device, the method comprising:

detecting a start and run event for the engine; and then controlling the engine at a stoichiometric air/fuel ratio using a multiple pulse fuel injection strategy wherein a portion of the fuel is injected late in the combustion cycle and retarding spark ignition timing relative to mean-best-torque timing for a period of time associated with achieving light-off temperature in the oxidation catalytic device; and then controlling the engine at a lean air/fuel ratio using the multiple pulse fuel injection strategy wherein a portion of the fuel is injected late in the combustion cycle and retarding the spark ignition timing relative to mean-best-torque timing for a period of time associated with achieving an efficient NOx conversion rate in the selective catalyst reduction device; and then operating the engine at a lean air/fuel ratio and controlling spark ignition timing to a preferred ignition timing; and then operating the engine in a first combustion mode comprising operating at a rich air/fuel ratio and advancing the spark ignition timing to generate reformates that form an ammonia reductant in the oxidation catalytic device and storing the ammonia reductant on the second aftertreatment device until ammonia slip from the second aftertreatment device exceeds a predetermined level; and then operating the engine at a preferred air/fuel ratio and controlling spark ignition timing to the preferred ignition timing until the stored ammonia reductant is depleted.

10. The method of claim 9, further comprising monitoring pressure drop across the particulate filter device upstream of the oxidation catalytic device; and, discontinuing operating the engine at the lean air/fuel ratio and controlling spark ignition timing to the preferred timing when the pressure drop across the particulate filter device is less than a predetermined threshold.

* * * * *